US005242054A

United States Patent [19]

Todd

[11] Patent Number: 5,242,054

[45] Date of Patent: Sep. 7, 1993

[54] METHOD FOR SHIPPING A DISPLAY RACK FOR PACKAGED SMALL FRAGILE ITEMS AND SHIPPING ASSEMBLY

[76] Inventor: Alvin E. Todd, P.O. Box 924, Pigeon Forge, Tenn. 37868-0924

[21] Appl. No.: 922,150

[22] Filed: Jul. 30, 1992

Related U.S. Application Data

[63] Continuation-in-part of Ser. No. 734,485, Jul. 23, 1991, and a continuation-in-part of Ser. No. 887,335, May 22, 1992.

[51] Int. Cl.[5] ..... B65D 71/08; B65D 65/16; B65B 53/02

[52] U.S. Cl. ..... 206/497; 206/45.14; 206/45.33; 206/521; 211/78; 211/163; 53/427; 53/442

[58] Field of Search ..... 206/44 R, 45.14, 45.33, 206/326, 461–463, 497, 521; 211/78, 71, 163; 53/427, 441, 442

[56] References Cited

U.S. PATENT DOCUMENTS

| | | | |
|---|---|---|---|
| 1,875,563 | 9/1932 | Cooke et al. . | |
| 3,127,993 | 4/1964 | Phipps . | |
| 3,129,817 | 4/1964 | Rohdin . | |
| 3,184,059 | 5/1965 | Kaplan . | |
| 3,298,515 | 1/1967 | Watts, Jr. . | |
| 3,693,807 | 9/1972 | Larson . | |
| 3,695,455 | 10/1972 | Larson | 211/78 |
| 3,761,289 | 9/1973 | Wolf . | |
| 3,861,528 | 1/1975 | Damuth . | |
| 3,861,578 | 1/1975 | McHan . | |
| 3,986,611 | 10/1976 | Dreher . | |
| 4,020,694 | 5/1977 | Mayhew . | |
| 4,170,294 | 10/1979 | Zelinski . | |
| 4,296,866 | 10/1981 | Learnard | 211/163 X |
| 4,319,684 | 3/1982 | Backman . | |
| 4,456,124 | 6/1984 | Kay . | |
| 4,499,353 | 2/1985 | Shields . | |
| 4,567,981 | 2/1986 | Headon . | |
| 4,669,610 | 6/1987 | Lindsey . | |
| 4,739,883 | 4/1988 | Mohs . | |
| 4,779,734 | 10/1988 | Kydonieus . | |
| 4,804,984 | 2/1989 | Heuer . | |
| 4,877,137 | 10/1989 | Govang . | |

FOREIGN PATENT DOCUMENTS

| | | |
|---|---|---|
| 270127 | 4/1960 | Austria . |

*Primary Examiner*—Bryon P. Gehman
*Attorney, Agent, or Firm*—Pitts & Brittian

[57] ABSTRACT

An improved method for shipping a display rack loaded with packaged small fragile items to provide greater protection during shipment and to provide greater convenience to the retail vendor in displaying the packaged items. Multiple packages are pre-placed on the rack and the rack is wrapped with shrink-wrap. Heat is applied and the shrink-wrap contracts pulling the packages into each other and more tightly against the rack. This wrapping makes the rack and packages easier to pack for shipment, provides further shock protection and saves the retailer time and energy in displaying the small fragile items.

13 Claims, 5 Drawing Sheets

METHOD FOR SHIPPING A DISPLAY RACK FOR PACKAGED SMALL FRAGILE ITEMS AND SHIPPING ASSEMBLY

This patent application is a Continuation-in-Part application based upon Ser. No. 07/734,485, filed Jul. 23, 1991, and Ser. No 07/887,335, filed May 22, 1992.

Technical Field

This invention relates to the field of shipping small fragile items such as ceramic ceiling fan pulls, which are packaged for retail display and sale.

BACKGROUND

Small fragile items, such as ceiling fan pulls which are used in conjunction with the pull chain of a ceiling fan, are often packaged individually for resale to the consumer. Heretofore, these packages, which are designed to hang from peg-hooks, have been shipped in loose bulk to retail vendors. The retailer then paid his or her employee to handle each packaged item and hang it from a display. For the convenience of the retailer, the manufacturer may wish to ship the packages pre-hung on a display rack. This saves the retailer the time, i.e. money, and energy that would otherwise be spent manually hanging the packages on a display. This can be very advantageous to the small manufacturer of specialty items, such as ceramic ceiling fan pulls, as it allows the manufacturer to cater to the convenience of the retailer. Thus enhancing retailer acceptance of the manufacturer's product.

Zelinski, in U.S. Pat. No. 4,170,294, entitled "Shipping and Display Tray and Package", teaches a flat based tray for shipping and subsequent display of oil filters for internal combustion engines. Zelinski teaches that the entire package may be shrink wrapped with a transparent material to aid in securing the filters to the tray especially during the rough handling of shipping.

Dreher, in U.S. Pat. No. 3,986,611, entitled "Cling Film Overwrap for Palletized Articles", teaches securing a palletized array of articles with at least two substantially superimposed tensioned wraps of a flexible cling film.

Todd, the inventor of the present invention, in U.S. Pat. No. 5,0900,570, entitled "Package for a Small Fragile Item" and Damuth in U.S. Pat. No. 3,861,528, entitled "Invertable Carded Blister Package" each teach various packages which may be hung from a peghook for display of a packaged item.

Govang et al. in U.S. Pat. No. 4,877,137, entitled "Display Package Module for Promotional Display Use" teaches a transport and merchandising assembly which consists of package modules which are wrapped in stacks and placed upon a pallet. The package modules consist of a tray-like base component and a sidewall component, the latter of which is easily removeable to expose the product units for display.

Getzner et al., in Austrian Patent No. 270,127, illustrates a four sided display stand with pegs for hanging packages.

Headon in U.S. Pat. No. 4,567,981, entitled "Display Packaging System", discloses a stackable display system for transporting and displaying a multiplicity of essentially similar, essentially rigid products. The Headon system is designed for a stack display of bottled or canned product.

Absent from the art is a method of shipping a modular rack display that is pre-hung with packages, that is wrapped with a heat shrinkable film that prevents the packages from migrating on the hooks and that can be easily removed from its shipping container and quickly assembled for display.

Accordingly, it is an object of this invention to provide a method of shipping a display rack designed for packaged small fragile items that provides for greater convenience to the retail vendor.

It is another object of the present invention to provide a method of pre-loading a modular display rack with packages and wrapping each module with a shrinkable film in order to prevent migration of the packages on the module.

It is another object of the present invention to provide such method that can be readily adaptable to pegboard style display racks or conventional wire-frame display racks.

Other objects and advantages of the present invention will become apparent upon reading the detailed description together with the drawings as described as follows.

DISCLOSURE OF THE INVENTION

In accordance with the various features of this invention, a method of shipping a display rack designed for packaged small fragile items to secure greater protection to the small fragile items during shipment and greater convenience to the retail vendor in moving the items from receiving to display is provided. The packaged small fragile items are shipped pre-hung, or loaded, upon a display rack that is modular and in which each loaded module is shrink-wrapped thus preventing the packages from migrating on the module. This migration otherwise would result in packages jostling against each other creating a breakage hazard.

BEST MODE FOR CARRYING OUT THE INVENTION

Figure 1:
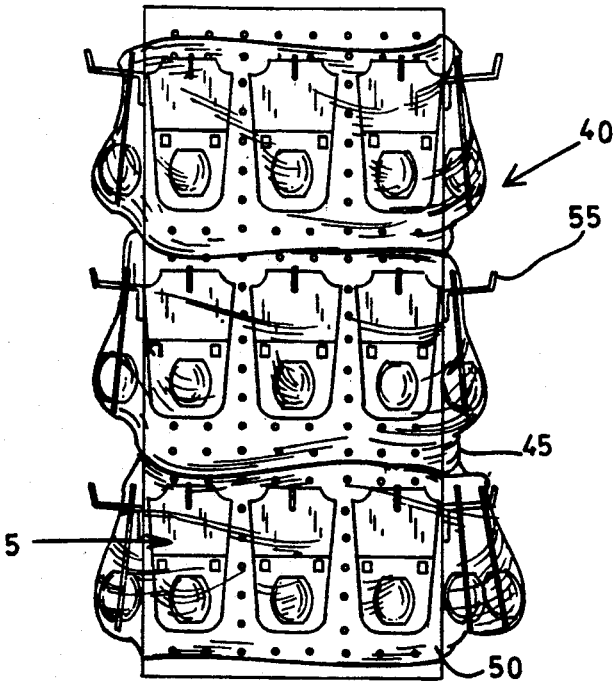
FIG. 1 illustrates an elevation view of a rack loaded with packages and shrink-wrapped in accordance with various features of the preferred invention.
Figure 2:
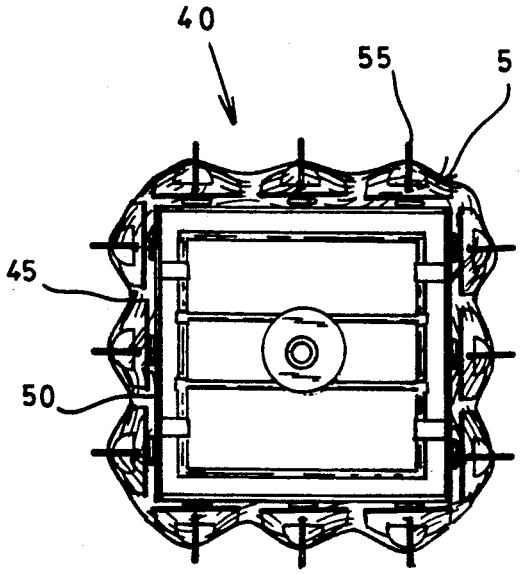
FIG. 2 illustrates a plan view of the rack loaded with packages and shrink-wrapped in accordance with various features of the present invention.
Figure 3:
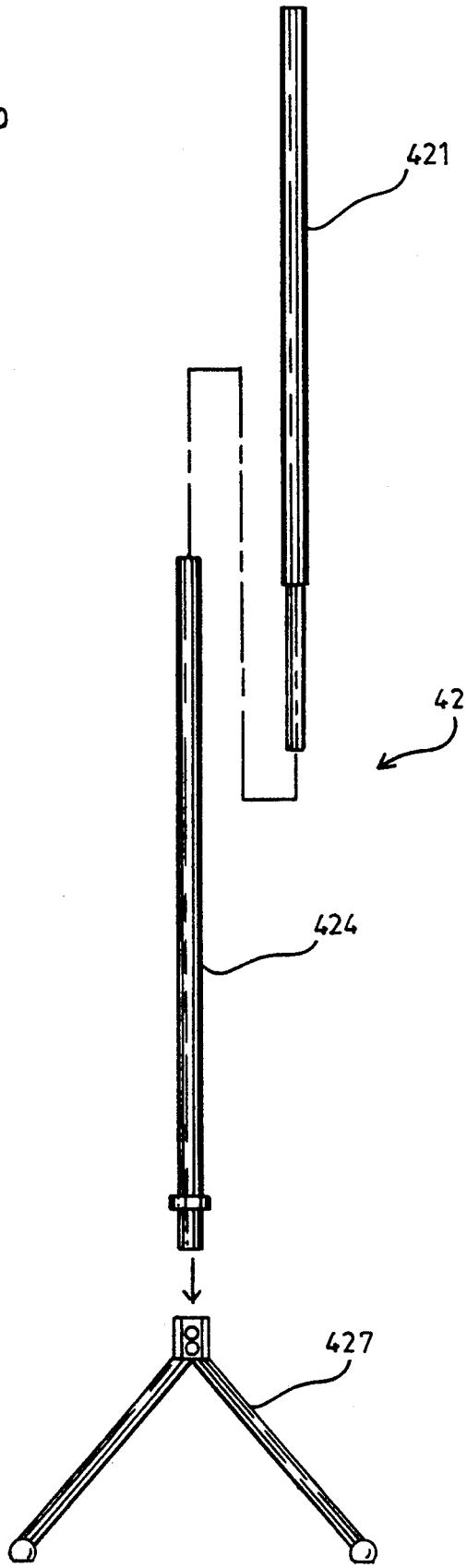
FIG. 3 illustrates a side elevational view of the sectional display rack support utilized in the preferred embodiment.

For purposes of shipment to the retailer and for further protection of a product packaged in package 5, package 5 may be pre-hung on rack 40 and shrink-wrapped with shrink-wrap 45. Shrink-wrap 45 comprises a mono-layered film of a heat shrinkable, synthetic, polymeric resin. Rack 40 consists of a plurality of package support means 55. Rack 40 also consists of at least one planar support member 50 which provides a vertical surface area against which the packages are pressed by the outer layer 45 of shrink-wrap. A plurality of packages 5 are placed upon each package support means 55. Rack 40 is then spiral wrapped with the outer layer 45 of shrink-wrap. Outer layer 45 of shrink-wrap is then exposed to hot air which causes the shrink-wrap to contract. This pulls the packages 5 into close conformity with each other and with planar support member 50. Rack 40 further comprises a rack support means 42 for supporting rack 40 while displaying the packages 5. In the preferred embodiment, rack support 42 is a sectional support consisting of a top section 421, a center section 424 and a leg section 427.

Figure 4:
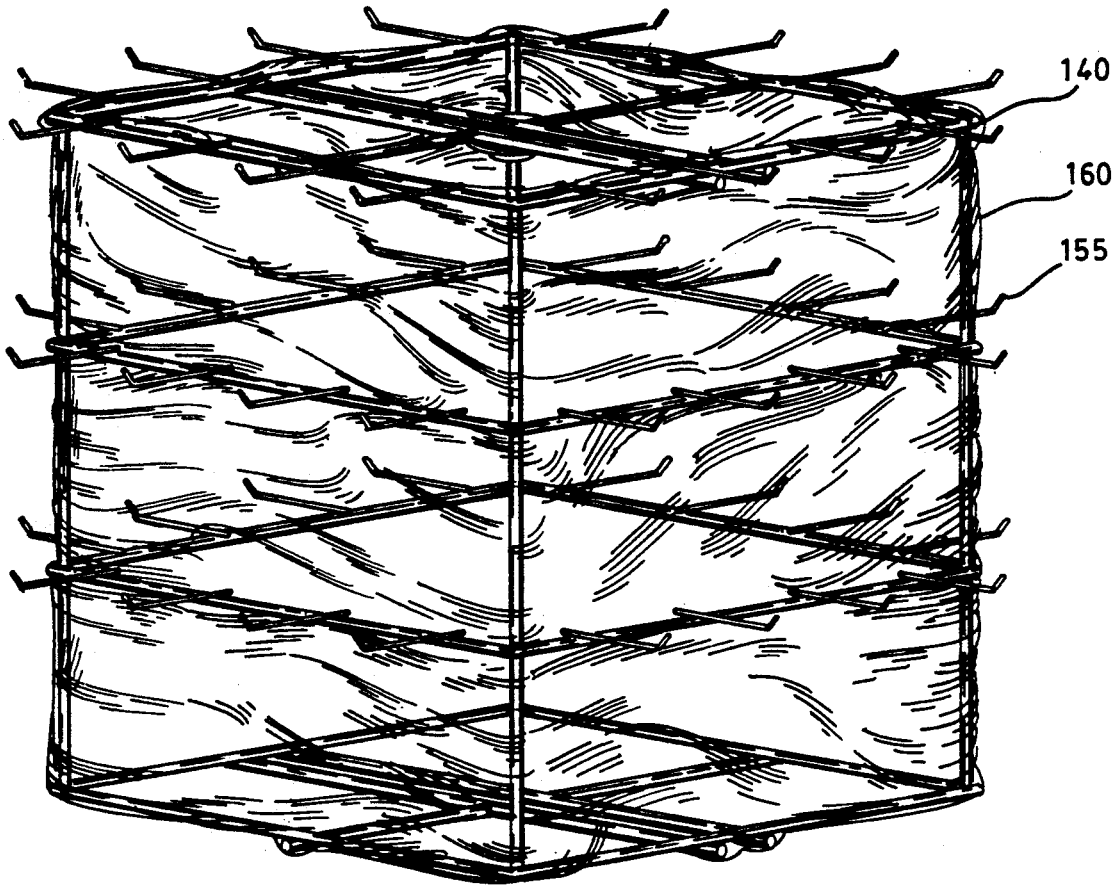
FIG. 4 illustrates a perspective view of a display rack, wrapped with a first layer of shrink-wrap according to an alternate embodiment of the present invention.
Figure 5:
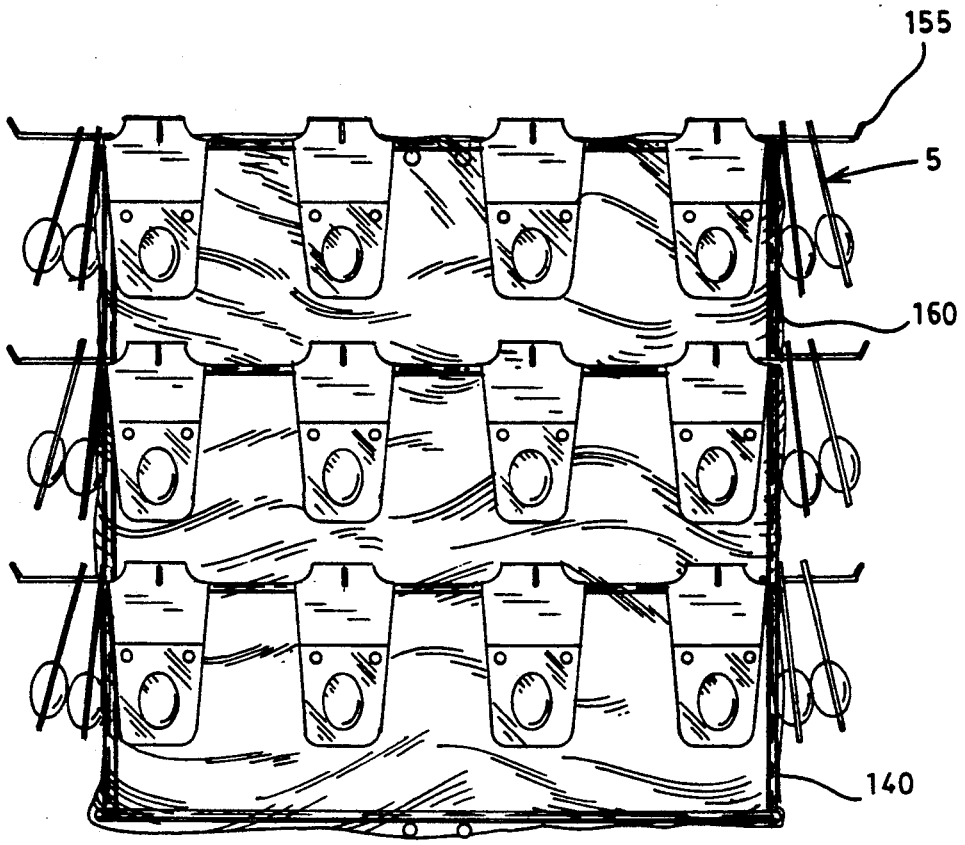
FIG. 5 illustrates a side elevation view of the display rack shown in FIG. 4 after being loaded with packages to be displayed.
Figure 6:
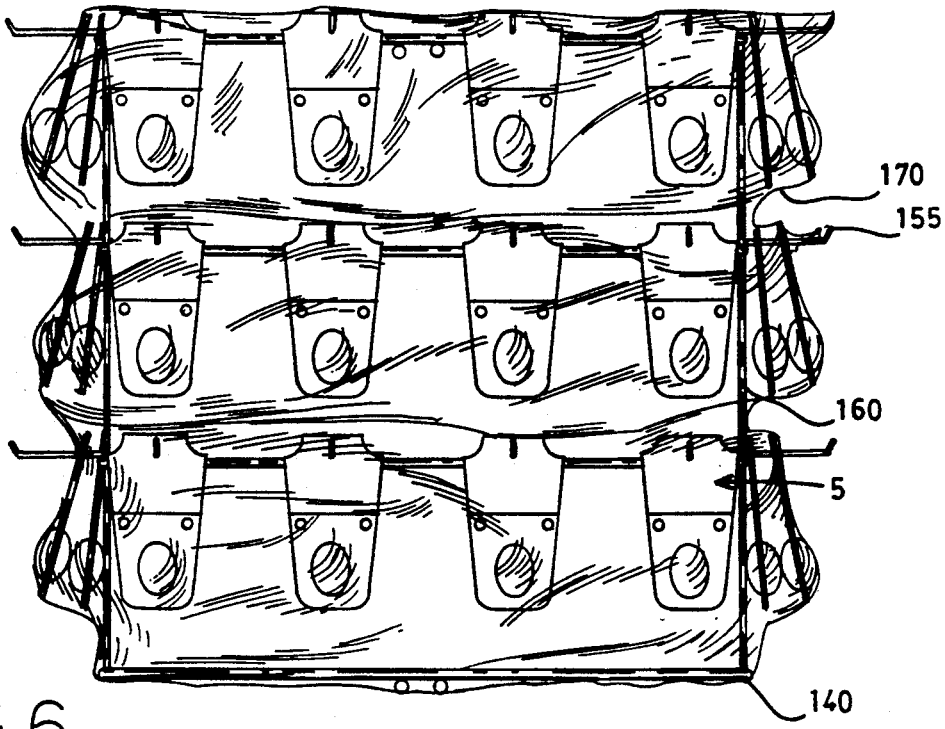
FIG. 6 illustrates a side elevation view of the display rack shown in FIG. 5 after the final layer of shrink-wrap has been applied.
Figure 7:
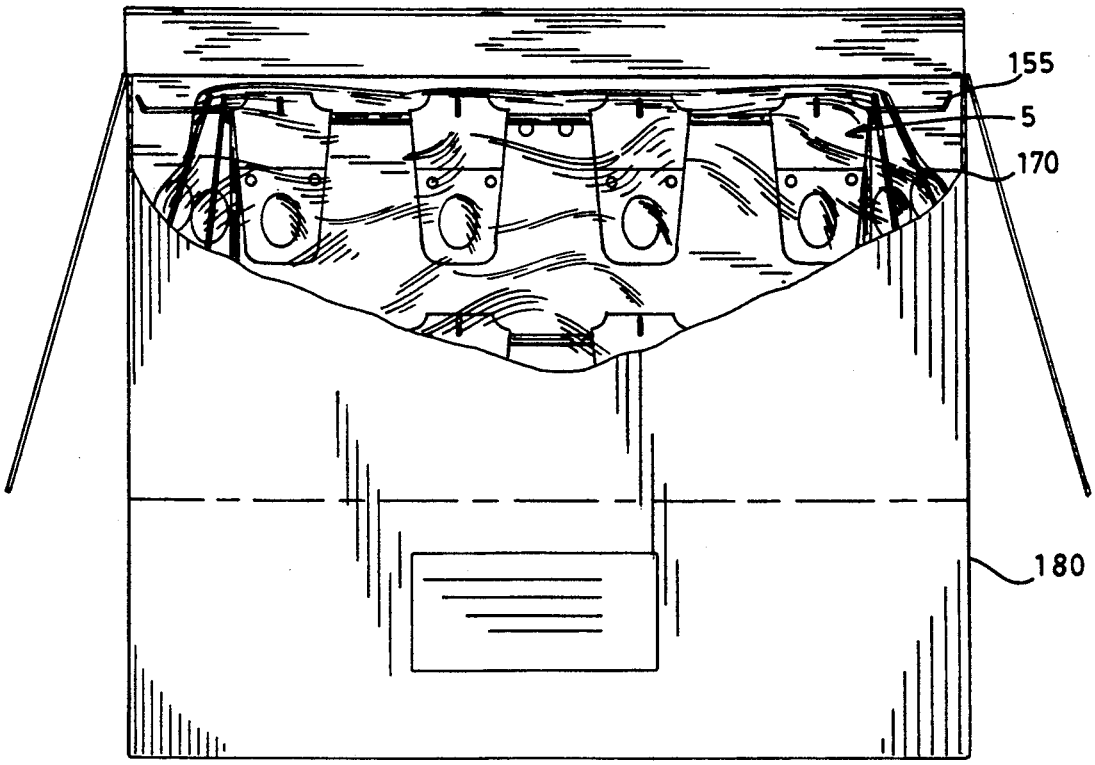
FIG. 7 illustrates a side elevation view of the display rack shown in FIG. 6 in a shipping carton which is shown in partial section.

In an alternate embodiment, a wire frame display rack is utilized. A modular rack member 155 is wrapped with a support layer 160 of shrink-wrap, see FIG. 4. This provides the planar support member which provides a vertical surface area against which the packages are pressed. A plurality of packages 5 are then hung from hooks 155 as is seen in FIG. 5. A compressing layer 170 of shrink-wrap is then spirally wrapped around modular rack member 155 and the plurality of packages 5 hung thereon. Compressing layer 170 presses packages 5 in close proximity with one another and also in close proximity with support layer 160. This prevents the packages 5 from moving freely on hook 155. Once wrapped with compressing layer 170, modular rack member 155 is placed within a shipping carton 180. Shipping carton 180 has an interior dimension that is selectively sized so as to prevent excessive movement of modular rack member 155 within shipping carton 180. Sections 421, 424 and 427 are shipped disassembled and can be packed in a separate shipping carton or in the corner spaces (not shown) of shipping carton 180.

Figure 8:
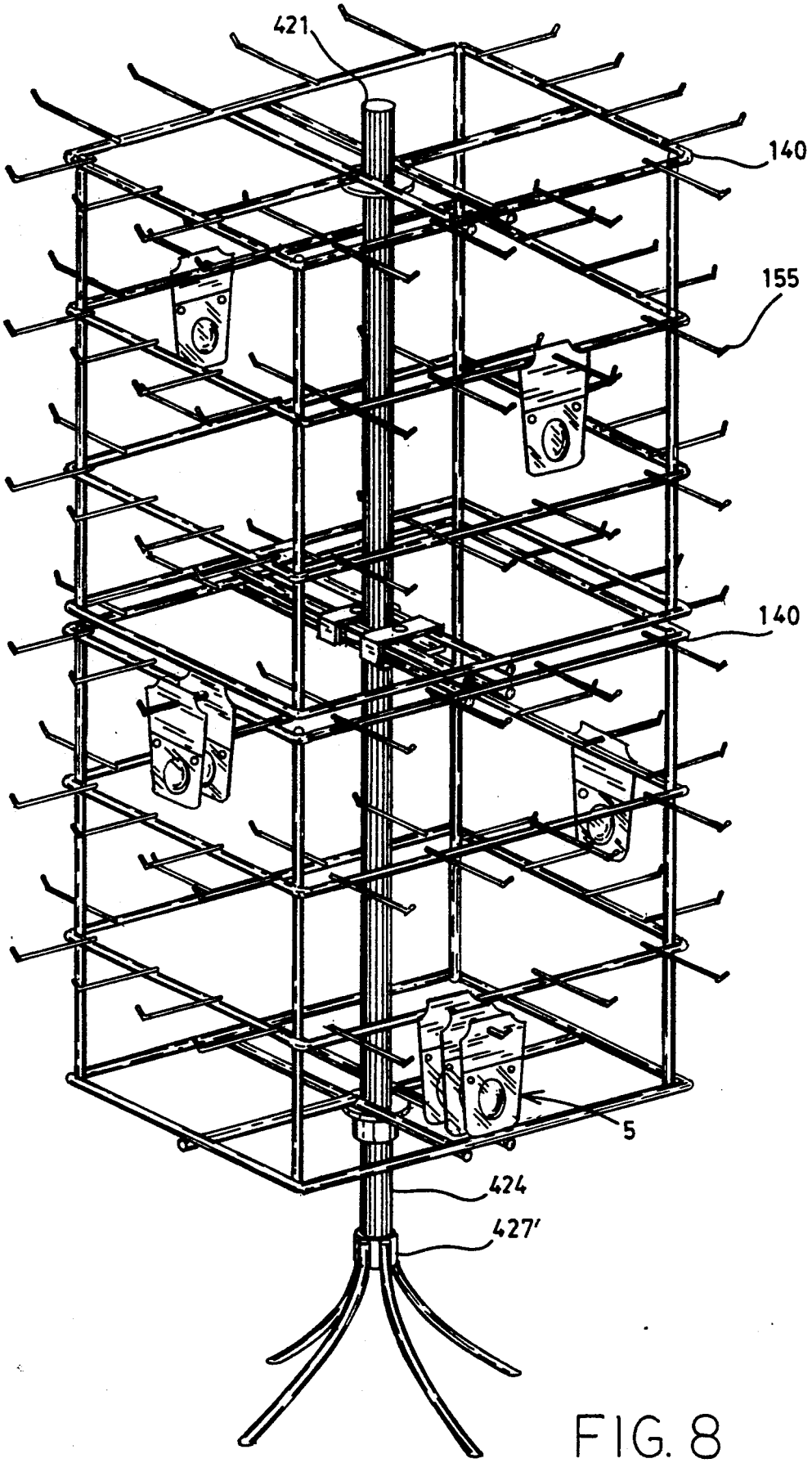
FIG. 8 illustrates a perspective view of the assembled display rack with a exemplary display of packages.

In order to prepare the display, the retailer simply removes modular rack member 155 from shipping carton 180 and removes compressing layer 170. Sections 421, 424 and 427 are assembled and modular rack member 155 upon section 424 in a conventional manner. If a full sized display is desired, top section 421 can be installed in section 424, conventionally, and a second modular rack member 155 placed thereon. Promotional indicia, not shown, may be placed atop the uppermost modular rack member 155. FIG. 8 shows an assembled full size display with an alternate leg section 427'. Support layer 160 can be removed from the inside of modular rack member 155 or alternatively left in place.

From the foregoing description, it will be recognized by those skilled in the art that a method of shipping a display rack designed for packaged small fragile items that provides for greater convenience to the retail vendor has been provided. The method further provides a method of pre-loading a modular display rack with packages and wrapping each module with a shrinkable film in order to prevent migration of the packages on the module and that can be readily adaptable to pegboard style display racks or conventional wire-frame display racks.

Though a preferred embodiment has been illustrated and described along with an alternative embodiment, it is of course understood that various modifications thereof will become apparent to those skilled in the art and, accordingly, the scope of the present invention should be defined only by the appended claims and their equivalents thereof.

Having thus described the aforementioned invention, I claim:

1. A method for shipping a display rack for displaying small fragile items wherein said items are protected from breakage during shipment and said display rack can be readily assembled and said packages displayed at the convenience of a retailer, said method comprising the steps:

packaging small fragile items in packages suitable for display;

hanging said packages on a display rack wherein said display rack has means for supporting said display rack, is modular and has at least one modular rack member, each said modular rack member having means for receiving said packages in a hanging manner and at least one planar support member which provides a vertical surface;

wrapping said at least one modular rack member and said plurality of said packages hung thereon with a plastic film whereby said packages are prevented from moving freely upon said at least one modular rack member and said packages are held in close conformity with each other and are held in close conformity with said vertical surface provided by said at least one planar support member support member during said shipment; and placing said at least one modular rack member within a shipping carton having a interior dimension selectively sized so as to prevent movement of said at least one modular rack member within said shipping carton.

2. The method of claim 1 wherein said step of wrapping said rack further comprises spiral wrapping said rack and said plurality of said packages hung thereon tightly with said plastic film.

3. The method of claim 1 wherein said plastic film is a mono-layered film of a heat shrinkable, synthetic, polymeric resin.

4. A method for shipping a display rack for displaying small fragile items wherein said items are protected from breakage during shipment and said display rack can be readily assembled and said packages displayed at the convenience of a retailer, said method comprising the steps:

individually packaging small fragile items in packages suitable for display;

hanging said packages on a display rack wherein said display rack has means for supporting said display rack, is modular and has at least one modular rack member, each said modular rack member having means for receiving said packages in a hanging manner and which provides a vertical surface;

spirally wrapping said at least one modular rack member and said plurality of said packages hung thereon with a mono-layered film of a heat shrinkable, synthetic polymeric resin whereby said packages are prevented from moving freely upon said at least one modular rack member and said packages are held in close conformity with each other and are held in close conformity with said vertical surface provided by said at least one planar support member support member during said shipment;

placing said at least one modular rack member within a shipping carton having a interior dimension selectively sized so as to prevent movement of said at least one modular rack member within said shipping carton; and removing said mono-layered film from said at least one modular rack member and said plurality of said packages hung thereon.

5. The method of claim 4 wherein said display rack is a pegboard-type display rack.

6. The method of claim 4 wherein said display rack is a wire frame display rack.

7. The method of claim 6 wherein prior to said step of hanging said packages on said display rack, said display rack is wrapped with a first layer of mono-layered film, thereby providing said at least one planar support member.

8. A method for shipping a display rack for displaying small fragile items wherein said items are protected from breakage during shipment and said display rack can be readily assembled and said packages displayed at the convenience of a retailer, said method comprising the steps:

packaging small fragile items individually in packages suitable for display;

wrapping a display rack with a first layer of a plastic film, thereby providing a substantially planar vertical support area for said packages to rest against;

hanging said packages on said display rack against said first layer of said plastic film;

wrapping said rack and said plurality of said packages hung thereon with a second layer of plastic film whereby said packages are prevented from moving freely upon said rack and said packages are held in close conformity with each other and are held in close conformity with said first layer of said plastic film; and removing said film from said rack and packages after said shipment for display of said packages on said rack.

9. The method of claim 8 wherein said step of wrapping said rack further comprises spiral wrapping said rack and said plurality of said packages hung thereon tightly with said plastic film.

10. The method of claim 8 wherein said plastic film is a mono-layered film of a heat shrinkable, synthetic, polymeric resin.

11. The method of claim 8 wherein said small fragile items are ceramic ceiling fan pulls.

12. An assembly for protecting a plurality of small fragile items during shipment, and for displaying said small fragile items, wherein said assembly allows for rapid display of said small fragile items in a hanging manner on a display rack, said assembly comprising:

a plurality of packages each encapsulating displaying an individual small fragile item for retail sale, each said encapsulating package having a shell member of a semirigid transparent material, means for providing shock absorbance and means for hanging for display;

a display rack having means for supporting at least one of said encapsulating packages in hanging relationship to said rack, wherein said encapsulating packages are hung on said rack and wherein said rack is further provided with means for supporting said rack above a support surface during display of said items by a retailer;

means for providing a substantially planar vertical support area against which said encapsulating packages are hung;

said means for providing a substantially planar vertical support area comprises a first layer of shrink-wrap applied to said display rack prior to hanging said packages on said display rack; and removable plastic wrapping encasing said encapsulating packages hung upon said rack, said plastic wrapping holding said encapsulating packages in close conformity with each other and in close support with said means for providing a substantially planar vertical support area thereby preventing movement of said packages during shipment of said assembly and whereby said packages are freely displayed by said retailer after removal of said wrapping.

13. The assembly of claim 12 wherein said plastic wrapping is a mono-layered heat shrinkable film, and said plastic wrapping is spiral wound around said rack and said packages.

* * * * *

UNITED STATES PATENT AND TRADEMARK OFFICE

CERTIFICATE OF CORRECTION

PATENT NO. : 5,242,054

DATED : September 7, 1993

INVENTOR(S) : Alvin E. Todd

It is certified that error appears in the above-identified patent and that said Letters Patent is hereby corrected as shown below:

On page 6, line 30, "rack member 155" should read --rack member 140--.

On page 7, lines 6, 13, 17, 23, 26, and 31, "rack member 155" should read --rack member 140--.

On page 8, lines 2 and 6, "rack member 155" should read --rack member 140--.

Signed and Sealed this

Nineteenth Day of April, 1994

Bruce Lehman

*Attest:*

BRUCE LEHMAN

*Attesting Officer*

*Commissioner of Patents and Trademarks*